US008002275B2

(12) United States Patent
Hayakawa

(10) Patent No.: US 8,002,275 B2
(45) Date of Patent: Aug. 23, 2011

(54) SHEET CONVEYING APPARATUS AND IMAGE FORMING APPARATUS HAVING A FIRST SKEW FEEDING CORRECTION UNIT AND A SECOND SKEW FEEDING CORRECTION UNIT

(75) Inventor: Takuya Hayakawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 12/323,680

(22) Filed: Nov. 26, 2008

(65) Prior Publication Data

US 2009/0134570 A1 May 28, 2009

(30) Foreign Application Priority Data

Nov. 28, 2007 (JP) ..... 2007-307499

(51) Int. Cl.
*B65H 7/02* (2006.01)

(52) U.S. Cl. ..... 271/227; 271/226; 271/270

(58) Field of Classification Search ..... 271/226–231, 271/270

See application file for complete search history.

(56) References Cited

U.S. PATENT DOCUMENTS 5,090,683 A * 2/1992 Kamath et al. ..... 271/227
5,732,943 A * 3/1998 Delfosse ..... 271/228
6,994,339 B2 2/2006 Kato et al. ..... 270/58.12
7,007,948 B2 3/2006 Kamiya et al. ..... 271/221
7,694,962 B2 * 4/2010 Morya et al. ..... 271/228
2006/0239733 A1 * 10/2006 Choi et al. ..... 399/396
2007/0023994 A1 * 2/2007 Mandel et al. ..... 271/226
2008/0237979 A1 * 10/2008 Tamura et al. ..... 271/270
2010/0061783 A1 * 3/2010 Kawasaki et al. ..... 399/381

* cited by examiner

*Primary Examiner* — Jeremy Severson

(74) *Attorney, Agent, or Firm* — Fitzpatrick, Cella, Harper & Scinto

(57) ABSTRACT

A sheet conveying apparatus includes a plurality of skew feeding correction rollers, a detection portion and a control portion which controls each sheet conveying speed of the plurality of skew feeding correction rollers so as to perform skew feeding correction of the sheet depending on the output from the detection portion. The control portion controls the plurality of skew feeding correction rollers so as to perform skew feeding correction of the sheet while the sheet is conveyed in a state in which the sheet conveying speed of the plurality of skew feeding correction rollers is slower than that when the amount of skew feeding of the sheet is less than a predetermined amount of skew feeding when the amount of skew feeding exceeds the predetermined amount of skew feeding.

5 Claims, 15 Drawing Sheets

SKEW FEEDING CORRECTION TIME t0

SKEW FEEDING CORRECTION TIME t0

SHEET CONVEYING APPARATUS AND IMAGE FORMING APPARATUS HAVING A FIRST SKEW FEEDING CORRECTION UNIT AND A SECOND SKEW FEEDING CORRECTION UNIT

BACKGROUND OF THE INVENTION

1. Field of the Invention

The present invention relates to a sheet conveying apparatus and an image forming apparatus.

2. Description of the Related Art

With reference to conventional image forming apparatuses such as copying machines, printers, and facsimiles, an image forming portion has a sheet conveying apparatus which conveys a sheet which is a recording paper. For example, the sheet conveying apparatus has a skew feeding correction portion which performs skew feeding correction of the sheet in order to adjust the posture and position of the sheet until the sheet is conveyed to the image forming portion.

As such a skew feeding correction portion, an active skew feeding correction system which corrects skew feeding while the sheet is conveyed without once stopping the sheet in order to increase throughput such as image formation by making an interval between sheets (between papers) smaller has been suggested (referred to Patent documents 1 and 2).

FIG. 15 is a diagram illustrating a structure of a conventional skew feeding correction portion which performs skew feeding correction of the sheet by such an active skew feeding correction system. In FIG. 15, two skew feeding detection sensors 201*a* and 201*b* are provided at a sheet conveying path. The skew feeding detection sensors 201*a* and 201*b* are disposed at a predetermined interval in a direction perpendicular to the sheet conveying direction (hereinafter referred to as a width direction).

Skew feeding correction rollers 222*a* and 222*b* are disposed at a predetermined interval on the same axis in the width direction and they are driven by independent drive sources 221*a* and 221*b*. Further, pressure rollers 223*a* and 223*b* energized by a force means (not illustrated) are pressure-weld to the skew feeding correction rollers 222*a* and 222*b*.

Here, in the skew feeding correction portion having such a structure, when the edge of the sheet P conveyed from the upstream crosses each of the skew feeding detection sensors 201*a* and 201*b*, a signal indicating that the sheet P crossed is output from the skew feeding detection sensors 201*a* and 201*b*. Then, the inclination of the edge of the sheet is detected based on the signal and the sheet conveying speed of the skew feeding correction rollers 222*a* and 222*b* is controlled to correct skew feeding of the sheet P.

Thus, in the active skew feeding correction system, skew feeding correction is performed without stopping the conveyance of the sheet, which allows the sheet conveying efficiency to be improved. It can be contemplated to improve the image formation speed substantially without increasing a process speed of image formation in the image forming apparatus. Therefore, the use of the active skew feeding correction system can respond to an increase in speed of image formation in the image forming apparatus in recent years.

In the sheet conveying apparatus having such a conventional skew feeding correction portion, the sheet is rotated by the skew feeding correction rollers when skew feeding is corrected. Thus, when the sheet is nipped by a driving roller located at the upstream of the skew feeding correction roller, the sheet may be drawn out from the driving roller or the sheet, and may be twisted, which causes damage to the sheet.

On the other hand, when the sheet is not nipped by the driving roller located at the upstream of the skew feeding correction roller at the time of skew feeding correction, the speed difference between the skew feeding correction rollers becomes larger as skew feeding of the sheet becomes larger. Thus, when the speed difference between the skew feeding correction rollers becomes larger, the sheet is slipped over the skew feeding correction roller. As a result, an accuracy of skew feeding correction is deteriorated or damage on the sheet is caused.

SUMMARY OF THE INVENTION

The present invention has been achieved in view of the above circumstances and there is provided a sheet conveying apparatus which can prevent the accuracy of skew feeding correction of the sheet from being deteriorated and an image forming apparatus.

According to the present invention, there is provided a sheet conveying apparatus comprising: a first skew feeding correction member and a second skew feeding correction unit which is arranged in parallel to a width direction crossing to a sheet conveying direction and corrects skew feeding of a sheet by turning the sheet while the sheet is conveyed; a detection portion which outputs a signal depending on the amount of skew feeding of the sheet; and a control portion which controls each sheet conveying speed of the first and second skew feeding correction member so as to perform skew feeding correction of the sheet depending on the output from the detection portion; wherein the control portion controls the first and second skew feeding correction member so as to perform skew feeding correction of the sheet while the sheet is conveyed in a state in which an average speed of the sheet conveying speed of the first skew feeding correction member and the sheet conveying speed of the second skew feeding correction member is slower than that when the amount of skew feeding of the sheet is less than a predetermined amount of skew feeding when the amount of skew feeding exceeds the predetermined amount of skew feeding.

According to the present invention, when the amount of skew feeding exceeds a predetermined amount of skew feeding, skew feeding is corrected while a plurality of skew feeding correction rollers is set to a low speed and the sheet is conveyed, thereby preventing the accuracy of skew feeding correction of the sheet from being deteriorated.

Further feature of the present invention will become apparent from the following description of exemplary embodiments (with reference to the attached drawings).

DESCRIPTION OF THE EMBODIMENTS

Hereinafter, an exemplary embodiment of the present invention will be described in detail with reference to the drawings.

Figure 1:
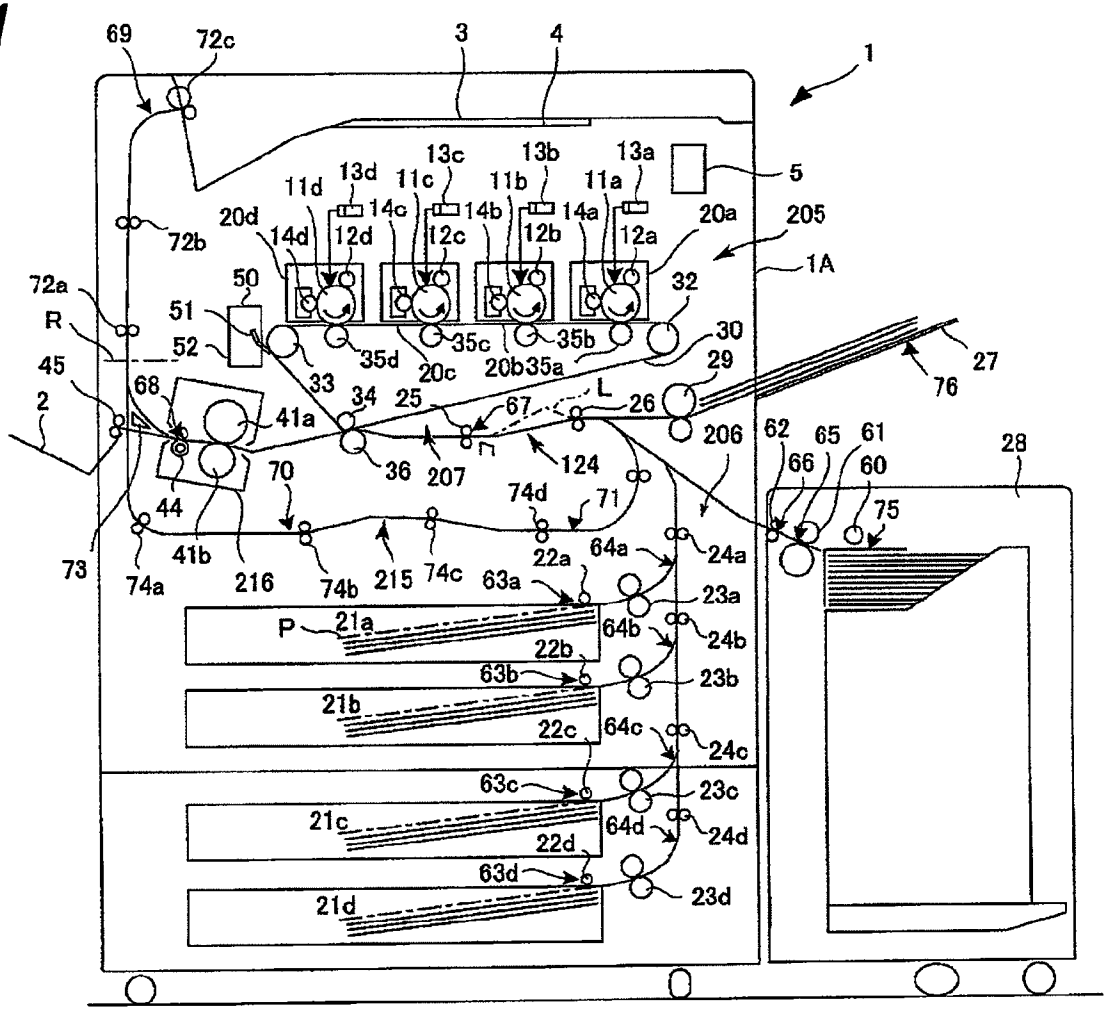
FIG. 1 is a diagram illustrating a schematic structure of a color printer that is one example of the image forming apparatus having a sheet conveying apparatus according to an embodiment of the present invention.

FIG. 1 is a diagram illustrating the schematic structure of the color printer that is one example of the image forming apparatus having the sheet conveying apparatus according to an embodiment of the present invention.

A color laser printer 1 and a color laser printer main body 1A (hereinafter referred to as a printer body) are illustrated in FIG. 1. An image forming portion 205 that forms an image on the sheet P, an intermediate transfer portion 207, a paper feeding portion 206 that feeds the sheet P to the image forming portion 205, and a fixing portion 216 are provided in the printer body 1A. In this regard, the color laser printer 1 can form an image on the back side of the sheet. Thus, a reconveying portion 215 that reverses the sheet P in which an image is formed on the surface (one surface) and conveys the sheet P to the image forming portion 205 again is provided.

Here, the image forming portion 205 is disposed in a nearly horizontal direction and has four process stations 20 (i.e., 20*a*, 20*b*, 20*c*, and 20*d*) which form toner images of four colors of yellow (Y), magenta (M), cyan (C), and black (Bk).

The process stations 20 hold toner images of four colors of yellow, magenta, cyan, and black and have photoconductive drums 11 (i.e., 11*a*, 11*b*, 12*c*, and 11*d*) which are image bearing members driven by a stepping motor (not illustrated). Further, the process stations 20 have roller charging type devices 12 (i.e., 12*a*, 12*b*, 12*c*, and 12*d*) which uniformly charge the surface of the photoconductive drums.

Furthermore, the process stations 20 have scanners 13 (i.e., 13*a*, 13*b*, 13*c*, and 13*d*) which form an electrostatic latent image on the photoconductive drum which irradiates a laser beam based on the image data and rotates at a constant rate. The process stations 20 have development apparatuses 14 (i.e., 14*a*, 14*b*, 14*c*, and 14*d*) which transfer toners of yellow, magenta, cyan, and black to the electrostatic latent image formed on the photoconductive drum in order to develop a toner image. The roller charging type device 12, the scanners 13, and the development apparatus 14 are respectively arranged along the rotational direction around the photoconductive drums 11.

The scanners 13 have a beam detect sensor (BD sensor, not illustrated) that detects a reflected light from a rotating polygon mirror. The timing of the image and the sheet can be synchronized by counting the number of laser beams entered into the BD sensor (BD signal). The scanner 13*a* exposing a black image outputs a signal obtained by dividing the BD signal at a predetermined division ratio to a CPU 501 (hereinafter described and illustrated in FIG. 3).

The paper feeding portion 206 is provided in the lower part of the printer body and has sheet cassettes 21 (i.e., 21*a*, 21*b*, 21*c*, and 21*d*) which house the sheet P and pickup rollers 22 (i.e., 22*a*, 22*b*, 22*c*, and 22*d*) which feed the sheet P stacked and housed in the sheet cassettes 21. Here, the pickup rollers 22 feed the sheet P through the cooperation of a gear and a cam when a solenoid 504 (hereinafter described and illustrated in FIG. 3) is operated.

In this regard, a manually paper feeding tray 27 is illustrated and a deck 28 houses the sheet P. The sheet P housed in the deck 28 is fed by a pickup roller 60.

When the image forming operation is started, the sheet P is one by one fed from the sheet cassettes 21 by the pickup rollers 22 or one by one fed from the deck 28 by the pickup roller 60. Then, the sheet P is conveyed to a registration roller 25 via drawing-out rollers 24 (i.e., 24*a*, 24*b*, 24*c*, and 24*d*), a drawing-out roller 62, and a pre-registration roller 26. The sheet P housed in the manually paper feeding tray 27 is one by one separated by a BC roller 29 and conveyed to the registration roller 25 by the pre-registration roller 26.

At this time, the registration roller 25 is in a stopped state. Thereafter, when the skew feeding of the sheet P is corrected as described hereinafter, the registration roller 25 is driven at a timing in which a toner image formed on an intermediate transfer belt 30 (described hereinafter) is synchronized with the edge of the sheet P.

The intermediate transfer portion 207 has the intermediate transfer belt 30, namely an intermediate transfer member which is synchronized with a peripheral speed of the photoconductive drums 11 and is rotated and driven along the arranging direction of each of the process stations 20 illustrated by an arrow. Here, the intermediate transfer belt 30 is laid across in a tensioned state between a driving roller 32 and a tension roller 33 which gives a moderate tension to the intermediate transfer belt 30 by energizing forces of a driven roller 34 which nips the intermediate transfer belt 30 to form a secondary transfer area and a spring (not illustrated).

Usable examples of a material of the intermediate transfer belt 30 include polyethylene terephthalate (PET) and polyvinylidene fluoride (PVdF). The driving roller 32 is rotated by transmission of torque from the stepping motor. Slipping from the intermediate transfer belt 30 is prevented by coating the surface of a metallic roller with a rubber (urethane or chloroprene) having a thickness of several mm.

Four pieces of the photoconductive drums 11 and primary transfer rollers 35 (i.e., 35*a*, 35*b*, 35*c*, and 35*d*) which nip the intermediate transfer belt 30 and include a primary transfer portion are arranged in the intermediate transfer belt 30. The primary transfer rollers 35 are connected to a power supply for a transfer bias (not illustrated). Each color toner image on the photoconductive drums is sequentially multiple-transferred onto the intermediate transfer belt 30 by applying the transfer bias to the intermediate transfer belt 30 by the primary transfer rollers 35 and then a full color image is formed on the intermediate transfer belt 30.

Further, a secondary transfer roller 36 is disposed so as to be opposed to the driven roller 34. The secondary transfer roller 36 abuts against the surface of the intermediate transfer belt 30 at the lowest side, nips the sheet P conveyed by the registration roller 25 with the intermediate transfer belt 30, and conveys it. When the sheet P passes through the nip portion between the secondary transfer roller 36 and the intermediate transfer belt 30, the toner image on the intermediate transfer belt 30 is secondarily transferred onto the sheet P by applying a bias to the secondary transfer roller 36.

In this regard, a cleaning apparatus 50 which has a cleaner blade 51 made of a polyurethane rubber and a waste toner box 52 housing a waste toner and cleans an image forming surface is provided at the downstream side of the secondary transfer area on the intermediate transfer belt 30.

A fixing portion 216 allows the toner image formed on the sheet P via the intermediate transfer belt 30 to be fixed on the sheet P. The fixing portion 216 has a pair of rollers 41*a* and 41*b* which includes a fixing roller 41*a* having a heat source therein and a roller 41*b* to be pressurized by the fixing roller 41*a* and an inner discharge roller 44 which conveys the sheet discharged from the pair of rollers 41*a* and 41*b*. When the sheet P holding the toner image passes through the fixing portion 216, the toner image is fixed thereto by applying heat and pressure.

Subsequently, image forming operation of the color laser printer 1 having such a structure will be described.

When the image forming operation is started, the photoconductive drum lid is irradiated with laser light by the scanner 13*d* in the process station 20*d* located at the most upstream in the rotative direction of the intermediate transfer belt 30 and a latent image is formed on the photoconductive drum 11*d*. Thereafter, the latent image is developed with toner in a development apparatus 14*d* to form a toner image.

Subsequently, the toner image thus formed on the photoconductive drum 11*d* is primarily transferred onto the intermediate transfer belt 30 in a primary transfer area by the transfer roller 35*d* to which a high voltage is applied. Next, the toner image is conveyed together with the intermediate transfer belt 30 to the primary transfer area which includes the photoconductive drum 11*c* of the next process station 20*c* in which the image is formed after a delay of the period of the toner image conveyance later than that of the process station 20*d* and the transfer roller 35*c*.

The next toner image is transferred onto the toner image on the intermediate transfer belt 30 so that the edge of the next toner image is superimposed on the edge of the toner image. Then, the same process is repeated. As a result, toner images of four colors are primarily transferred onto the intermediate transfer belt 30 and then a full color image is formed on the intermediate transfer belt 30.

Concurrently with such a toner image forming operation, the sheet P housed in the sheet cassettes 21 are one by one fed from the pickup rollers 22 and a BC roller 23 and then conveyed to the registration roller 25 via the drawing-out roller 24*a* and the pre-registration roller 26.

Alternatively, the sheet P housed in the deck 28 is one by one fed from the pickup roller 60 and a sheet feeding roller 61 and then is conveyed to the registration roller 25 via the drawing-out roller 62 and the pre-registration roller 26. Further the sheet housed in the manually paper feeding tray 27 is one by one separated by the BC roller 29 and conveyed to the registration roller 25 by the pre-registration roller 26.

At this time, the registration roller 25 is in a stopped state. Thereafter, the sheet P is conveyed to the nip portion between the secondary transfer roller 36 and the intermediate transfer belt 30 by the registration roller 25 which starts rotating at the timing in which the toner image formed on the intermediate transfer belt 30 is synchronized with the edge of the sheet P.

The sheet P is nipped by the secondary transfer roller 36 and the intermediate transfer belt 30 and conveyed. When the sheet P passes through the nip portion between the secondary transfer roller 36 and the intermediate transfer belt 30, the toner image on the intermediate transfer belt 30 is secondarily transferred onto the sheet P by the bias that is applied to the secondary transfer roller 36.

Subsequently, the sheet P in which the toner image is thus transferred is heated and pressurized in the fixing portion 216. As a result, the toner image is fixed thereto. Thereafter, the sheet P in which the image is fixed in such a manner passes through the inner discharge roller 44 and then a conveying destination is switched by a switching member 73.

Here, when the switching member 73 is located at a face-up paper discharge side, the sheet is discharged to a face-up paper discharge tray 2 by an outer discharge roller 45. On the other hand, when the switching member 73 is located at a face-down paper discharge side, the sheet is conveyed in the direction of the reversal rollers 72 (i.e., 72*a*, 72*b*, and 72*c*) and then discharged to a face-down paper discharge tray 3. When the image is formed on both (duplex) sides of the sheet, the sheet P is entered into the reconveying portion 215 by switchback by the reversal rollers 72 and then conveyed to the registration roller 25 again by reconveying rollers 74 (i.e., 74*a*, 74*b*, 74*c*, and 74*d*).

Paper feeding retry sensors 64*a* to 64*d*, a deck drawing-out sensor 66, a registration sensor 67, an inner paper discharge sensor 68, a face-down paper discharge sensor 69, a duplex pre-registration sensor 70, and a duplex paper re-feeding sensor 71 are illustrated in FIG. 1. These sensors detect when the sheet passes through the conveying path. Further, a manually feeding tray paper detecting sensor 76 detects the presence of the sheet on the manually paper feeding tray 27. A control unit 5 controls operations necessary for the image formation of the printer body 1A. An operation portion 4 is disposed on the upper surface of the printer body 1A.

The selection of feeding methods (cassette feeding, deck feeding, and manual paper feeding), the selection of the paper discharge trays (the face-up tray 2 and the face down tray 3), and the selection of the type of sheet are performed by the operation portion 4.

In FIG. 1, a sheet conveying apparatus 124 conveys the sheet P fed by the paper feeding portion 206 to the image forming portion 205. The sheet conveying apparatus 124 has the drawing-out roller 24*a*, the pre-registration roller 26, and the registration roller 25. In the sheet conveying apparatus 124, a skew feeding correction unit 100 which corrects the skew feeding of the sheet is provided between the registration roller 25 and the pre-registration roller 26.

Figure 2:
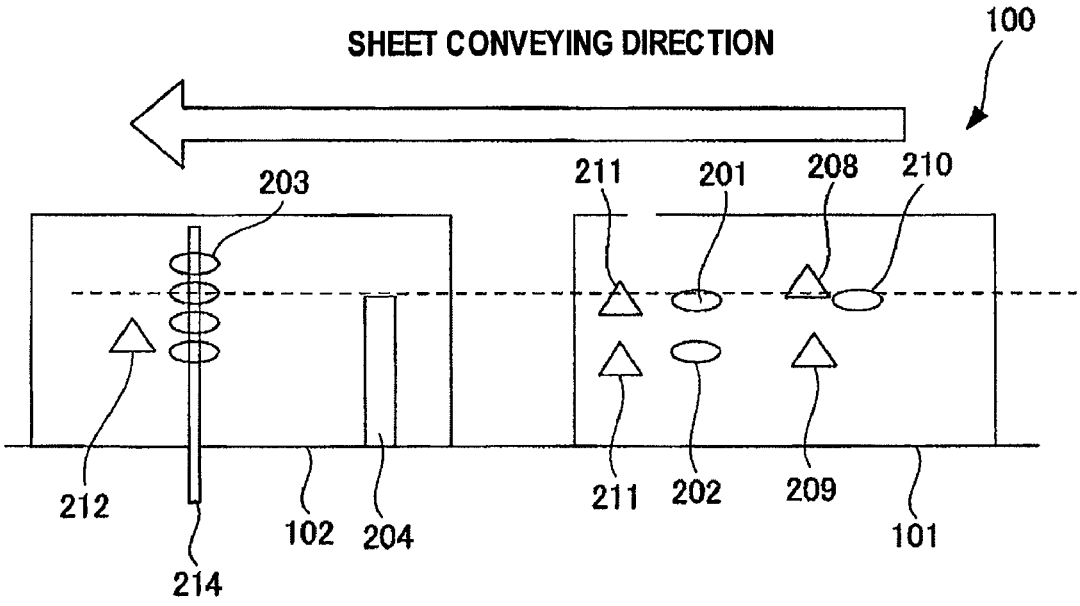
FIG. 2 is a diagram illustrating a structure of a skew feeding correction unit which is provided in the sheet conveying apparatus.

FIG. 2 is a diagram illustrating the structure of the skew feeding correction unit 100. As illustrated in FIG. 2, the skew feeding correction unit 100 has a skew feeding correction portion 101 which corrects a state of the skew-fed sheet to a state parallel to the sheet conveying direction and a return area 102 which returns the sheet in which the skew feeding is corrected by the skew feeding correction portion 101 to the center position.

Here, a first skew feeding correction roller 201 and a second skew feeding correction roller 202, i.e., pair (plurality) of skew feeding correction rollers which are disposed at a predetermined interval in the width direction and driven by the independent drive sources are provided at the skew feeding correction portion 101. The first skew feeding correction roller 201 and the second skew feeding correction roller 202 allow the sheet to turn while both rollers respectively convey the sheet, which results in correcting skew feeding of the sheet. The first and second skew feeding correction rollers 201,202 are first and second skew feeding members, where rotating belts could be used as the first and second skew feeding member instead of rollers.

As detection portions, a first skew feeding detection sensor 208 and a second skew feeding detection sensor 209, i.e., two (plurality) edge detection sensors which are disposed at a predetermined interval in the width direction and detect the edge of the sheet are provided at the upstream side in the sheet conveying direction of the first skew feeding correction roller 201 and the second skew feeding correction roller 202.

Further, an upstream roller 210, i.e., a conveying roller which conveys the sheet to the first skew feeding correction roller 201 and the second skew feeding correction roller 202 is provided at the upstream side in the sheet conveying direction of the first skew feeding detection sensor 208 and the second skew feeding detection sensor 209. Two skew feeding correction starting sensors 211 which are disposed at a predetermined interval in the width direction are provided at the downstream side in the sheet conveying direction of the first skew feeding correction roller 201 and the second skew feeding correction roller 202.

On the other hand, the return area 102 has a CIS 204 which detects the side edge position of the sheet which is corrected to the state parallel to the sheet conveying direction in the skew feeding correction portion 101 and a lateral shift roller 203 which is movable in the width direction while nipping the sheet. Further, in order to start lateral shift, a lateral shift initiation sensor 212 is provided.

Figure 3:
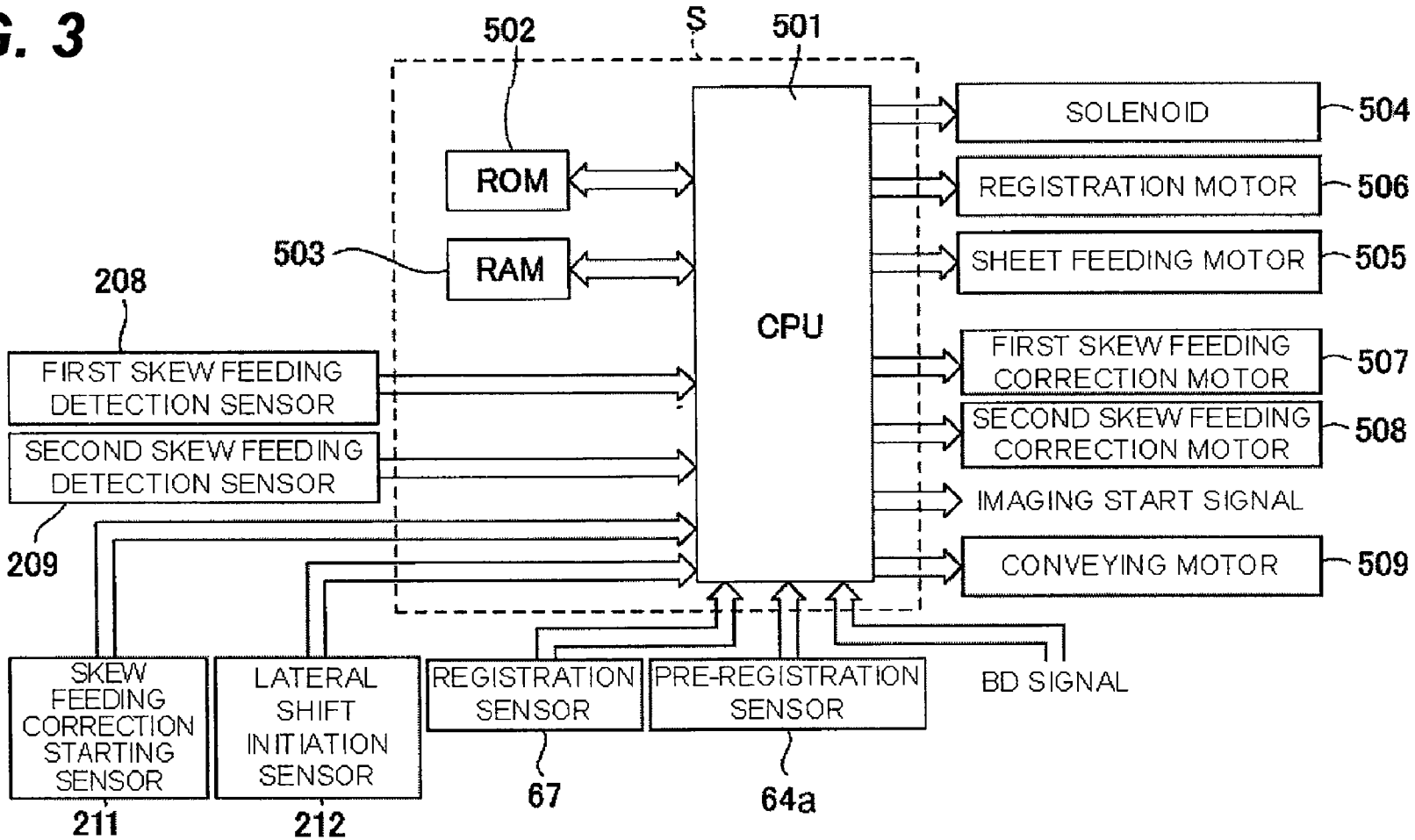
FIG. 3 is a control block diagram of the color laser printer.

FIG. 3 is a control block diagram of the color laser printer 1 having such a structure. A CPU 501, a ROM 502 in which a control program which should be executed by the CPU 501 is stored, and a RAM 503 at the time of program execution are illustrated in FIG. 3.

A paper feeding motor 505 drives the pickup rollers 22, the BC rollers 23 and 29, and the drawing-out roller 24. A solenoid 504 is driven when the sheet is fed by the pickup rollers 22. A registration motor 506 drives the registration roller 25.

BD signals from a registration sensor 67, a pre-registration sensor 64, and the scanners 13 are put into the CPU 501. In this regard, the CPU 501 has a plurality of timers (not illustrated) therein. One of the timers counts BD signals, generates a predetermined timing, and outputs an imaging start signal. Then, the image exposure is started by the imaging start signal.

A predetermined number of the BD signals are counted after the start of the image exposure. Then, the registration roller 25 is rotated by driving the registration motor 506. On the other hand, when the paper conveying operation is started after an appropriate time of the start of the image exposure in order to catch the start of rotation of the registration roller 25, the image can be synchronized with a sheet material.

In FIG. 3, a first skew feeding correction motor 507 and a second skew feeding correction motor 508 drive the first skew feeding correction roller 201 and the second skew feeding correction roller 202 and a conveying motor 509 drives the upstream roller 210. The CPU 501 increases and decreases the number of rotations of the first skew feeding correction motor 507, the second skew feeding correction motor 508, and the conveying motor 509 depending on to the amount of skew feeding of the sheet, thereby increasing and decreasing the sheet conveying speed of the first skew feeding correction roller 201, the second skew feeding correction roller 202, and the upstream roller 210.

Subsequently, skew feeding correction control according to the present embodiment will be described.

Figure 4A:
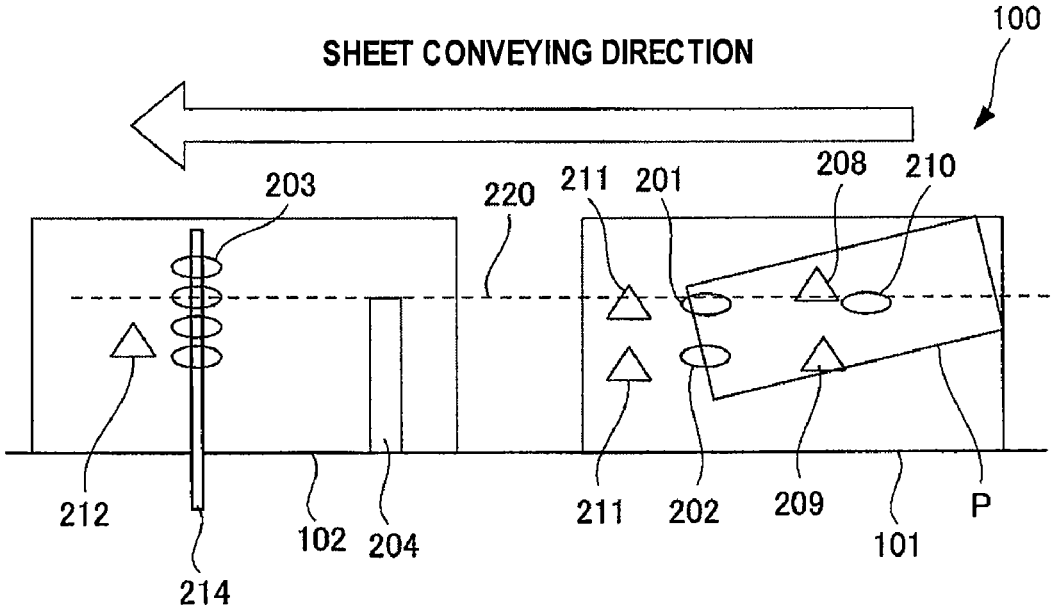
FIG. 4 is a first diagram describing skew feeding correction control operations by the skew feeding correction unit.
Figure 4B:
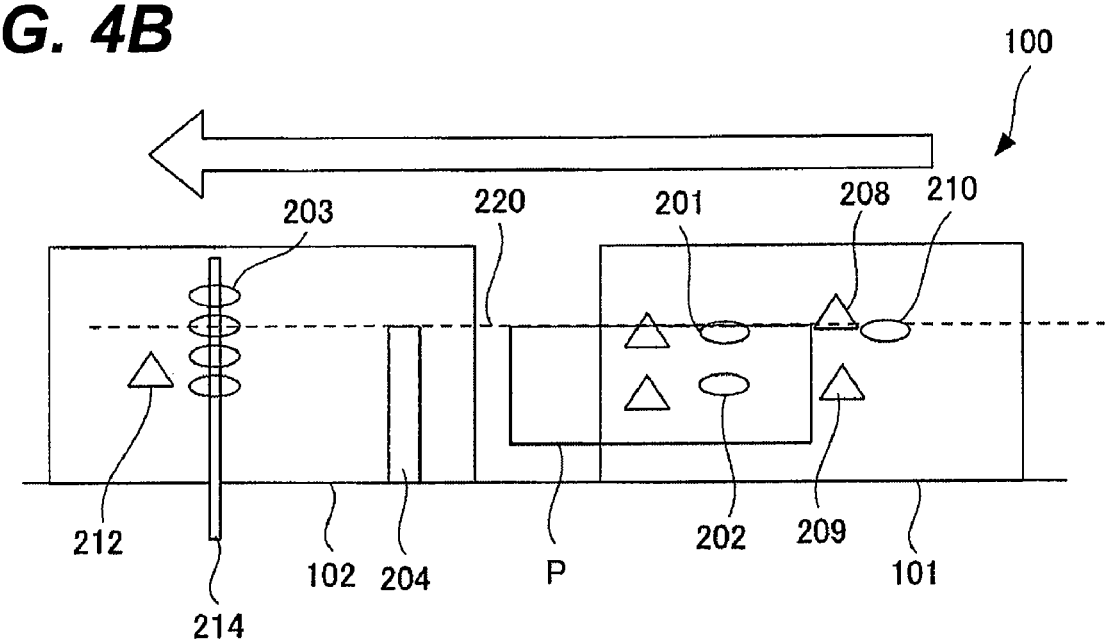

As illustrated in FIG. 4(*a*), when the sheet P is conveyed in a skew-fed state, the first skew feeding detection sensor 208 and the second skew feeding detection sensor 209 detect the edge of the sheet P in the skew-fed state at different timings. Then, detected signals from the first skew feeding detection sensor 208 and the second skew feeding detection sensor 209 are put into the CPU 501. The CPU 501 detects the amount of skew feeding based on a detection time lag of the edge of the sheet from the first skew feeding detection sensor 208 and the second skew feeding detection sensor 209.

Here, in the present embodiment, the CPU 501 determines whether the amount of the detected skew feeding of the sheet exceeds a predetermined amount of correctable skew feeding in the current sheet conveying speed. When it exceeds the predetermined amount, the sheet conveying speed is decelerated as described hereinafter.

When the edge of the sheet is detected by the skew feeding correction starting sensor 211, the delaying edge portion of the sheet is caught up with the preceding edge portion of the sheet by using the first skew feeding correction roller 201 and the second skew feeding correction roller 202 depending on the amount of the detected skew feeding as illustrated in FIG. 4(*b*).

Specifically, the delaying edge portion of the sheet is caught up with the preceding edge portion of the sheet by decelerating the speed of the skew feeding correction roller at the side of the preceding edge portion of the sheet for a given length of time. Alternatively, the delaying edge portion of the sheet is caught up with the preceding edge portion of the sheet by accelerating the speed of the skew feeding correction roller at the side of the delaying edge portion of the sheet for a given length of time. The given length of time is a value according to the amount of skew feeding. As above described when the amount of the detected skew feeding of the sheet exceeds the predetermined amount, the sheet conveying speed is decelerated. While the first skew feeding correction roller 201 and the second skew feeding correction roller 202 correct the skew feeding of the sheet, the sheet is conveyed in a state in which an average speed of the sheet conveying speed of the first skew feeding correction roller 201 and the sheet conveying speed of the second skew feeding correction roller 202 is slower than that when the amount of skew feeding of the sheet is less than the predetermined amount of skew feeding when the amount of skew feeding exceeds the predetermined amount of skew feeding.

Figure 5A:
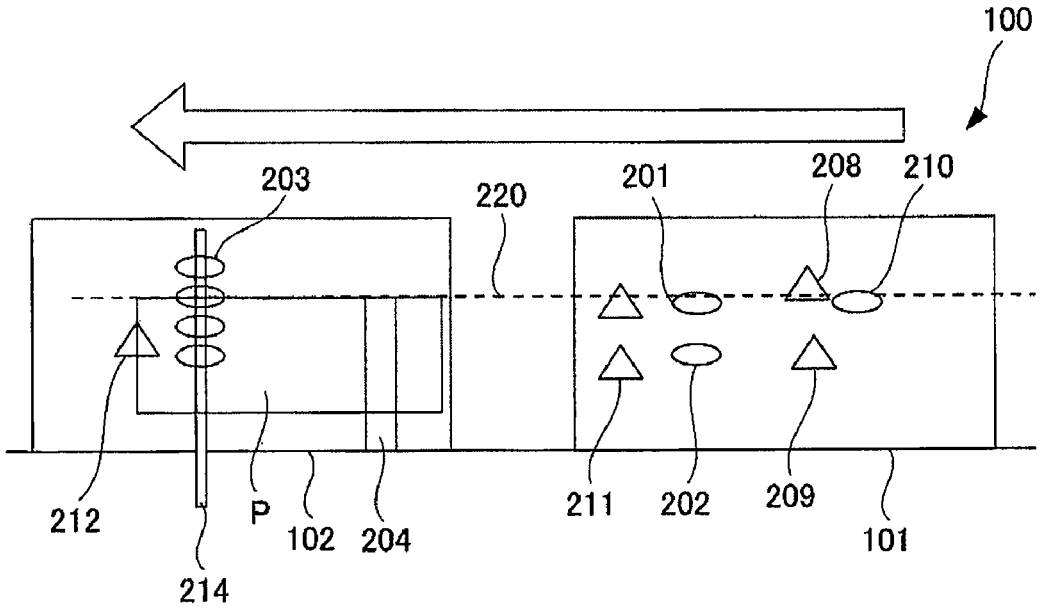
FIG. 5 is a second diagram describing skew feeding correction control operations by the skew feeding correction unit.
Figure 5B:
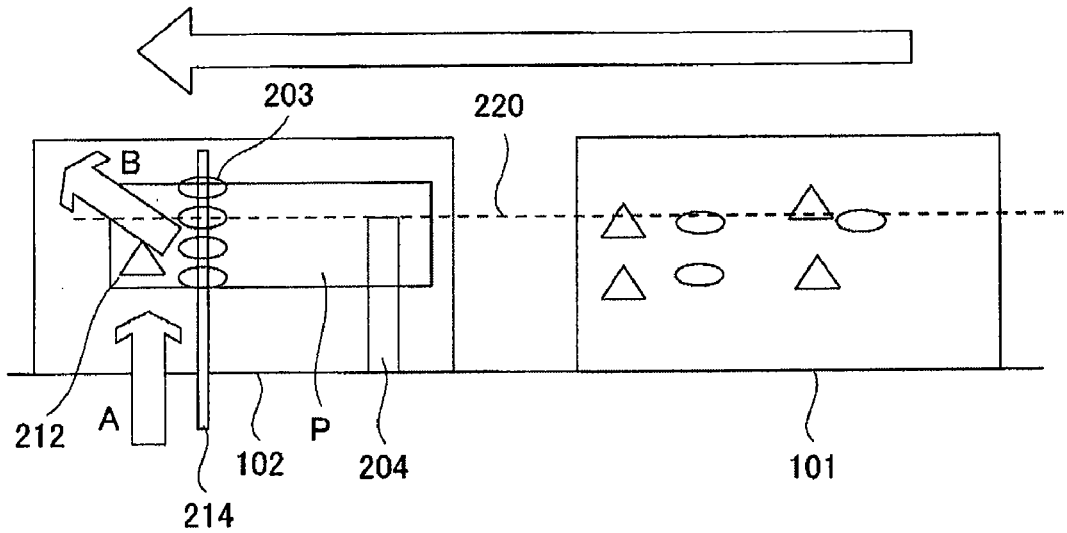

Subsequently, the sheet P passed through the skew feeding correction unit 101 is entered into the return area 102 in a state in which the sheet is deviated from a conveyance center 220 (indicated by a dashed line). Thus, in the return area 102, the lateral registration of the sheet P is measured with the CIS 204 as illustrated in FIG. 5(*a*). The data of the amount of lateral registration is put into the CPU 501. The CPU 501 moves a shift roller driving shaft 214 of the lateral shift roller 203 to the width direction based on the data of the amount of lateral registration.

The lateral shift roller 203 moves in the width direction indicated by an arrow A, as illustrated in FIG. 5 (*b*), as the movement of the shift roller driving shaft 214. Owing to this, the sheet P is conveyed in the direction indicated by an arrow B while the center of the sheet P is superposed on the conveyance center 220.

Figure 6:
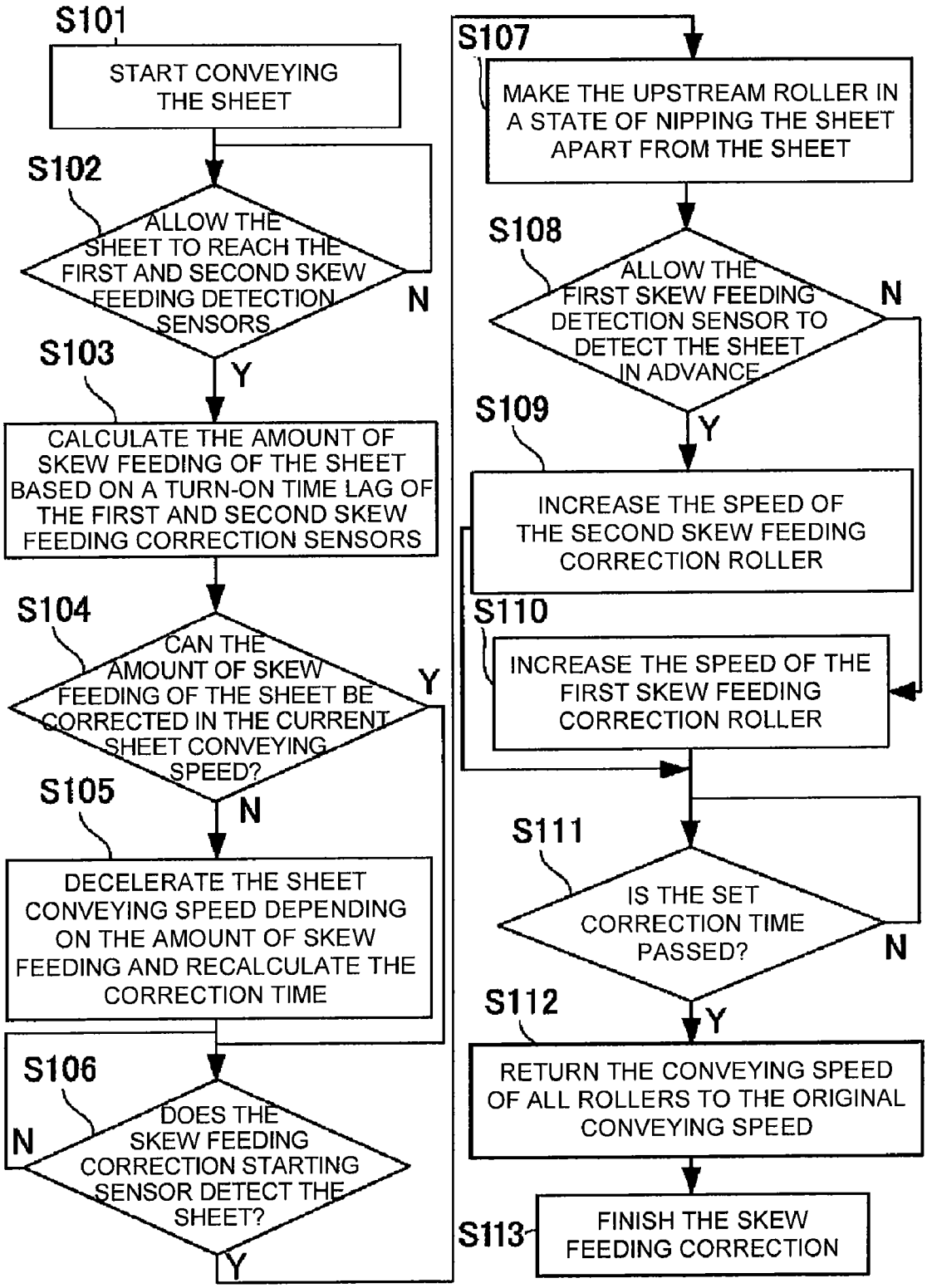
FIG. 6 is a flow chart describing one example of skew feeding correction control by the skew feeding correction unit.

Subsequently, the skew feeding correction control will be described with reference to the flow chart illustrated in FIG. 6.

When sheet conveying is started (S101), the sheet is entered into the skew feeding correction portion 101. Thereafter, when the edge of the sheet reaches the first skew feeding detection sensor 208 and the second skew feeding detection sensor 209 (Y of S102), the first skew feeding detection sensor 208 and the second skew feeding detection sensor 209 are turned on.

Here, when the sheet is skew-fed, the timing when the first skew feeding detection sensor 208 and the second skew feeding detection sensor 209 are turned on is different. Thus, the CPU 501 calculates (detects) the amount of skew feeding based on a turn-on time lag of the first skew feeding detection sensor 208 and the second skew feeding detection sensor 209 as well as the sheet conveying speed (S103).

Subsequently, the CPU 501 including the detection portion of the amount of skew feeding compares the calculated amount of skew feeding with a correctable skew feeding amount based on the sheet conveying speed which is stored in the ROM 502 and then determines whether the amount of skew feeding of the sheet can be corrected in the current sheet conveying speed (S104). That is, the CPU 501 determines whether the amount of skew feeding of the current sheet exceeds a predetermined amount of correctable skew feeding in the current sheet conveying speed.

As the result of comparison, when the CPU 501 determines that the amount of skew feeding can be corrected (Y of S104), in other words, when the CPU 501 determines that the amount of skew feeding of the sheet does not exceed the correctable skew feeding amount in the current sheet conveying speed, the CPU 501 waits for the skew feeding correction starting sensor 211 to detect the sheet (S106). Thereafter, when the skew feeding correction starting sensor 211 detects the sheet (Y of S106), the upstream roller 210 in a state of nipping the sheet is released (nip release) (S107) to make it apart from the sheet.

Then, it is confirmed whether the first skew feeding detection sensor 208 detects the sheet in advance (S108). When the sheet is detected by the first skew feeding detection sensor 208 in advance (Y of S108), the speed of the second skew feeding correction roller 202 is increased so that the edge portion of the sheet at the side of the second skew feeding detection sensor catches up with the edge portion of the sheet at the side of the first skew feeding detection sensor (S109). In this regard, the value to increase the speed varies depending on the sheet conveying speed at that time and the amount of skew feeding of the sheet.

When the sheet is not detected by the first skew feeding detection sensor 208 in advance (N of S108), the speed of the first skew feeding correction roller 201 is increased so that the edge portion of the sheet at the side of the first skew feeding detection sensor catches up with the edge portion of the sheet at the side of the second skew feeding detection sensor (S110). In this regard, the value to increase the speed also varies depending on the sheet conveying speed at that time and the amount of skew feeding of the sheet.

When the set correction time is passed after increasing the speed of the first skew feeding correction roller 201 or the second skew feeding correction roller 202 (Y of S111), the conveying speed of all rollers whose speed is changed is returned to the original conveying speed before the sheet reaches the skew feeding correction portion 101 (S112). Thus, the skew feeding correction is finished (S113).

As the result of comparison, when it is determined that the correction cannot be performed (N of S104), skew feeding cannot be corrected in the current sheet conveying speed within the correction time. Therefore, the sheet conveying speed is reduced (decelerated) to the sheet conveying speed in which skew feeding can be corrected depending on the amount of skew feeding.

Here, in the present embodiment, a table which matches the amount of skew feeding exceeding the predetermined amount of correctable skew feeding to the sheet conveying speed in the case of exceeding the predetermined amount of skew feeding is stored in the ROM 502. Based on the table, the sheet conveying speed is decelerated so as to be the sheet conveying speed according to the amount of skew feeding.

When the sheet conveying speed is decelerated in such a manner, the correction time for correcting the sheet is recalculated (S105). The correction time based on the sheet conveying speed is stored in the ROM 502. After recalculating the correction time in such a manner, the ROM 502 waits for the skew feeding correction starting sensor 211 to detect the sheet (S106).

The processing for increasing the sheet conveying speed so as to allow the delaying edge portion of the sheet to catch up with the preceding edge portion of the sheet when the sheet is skew-fed has been described. When the sheet is skew-fed, the sheet conveying speed may be decelerated.

Figure 7:
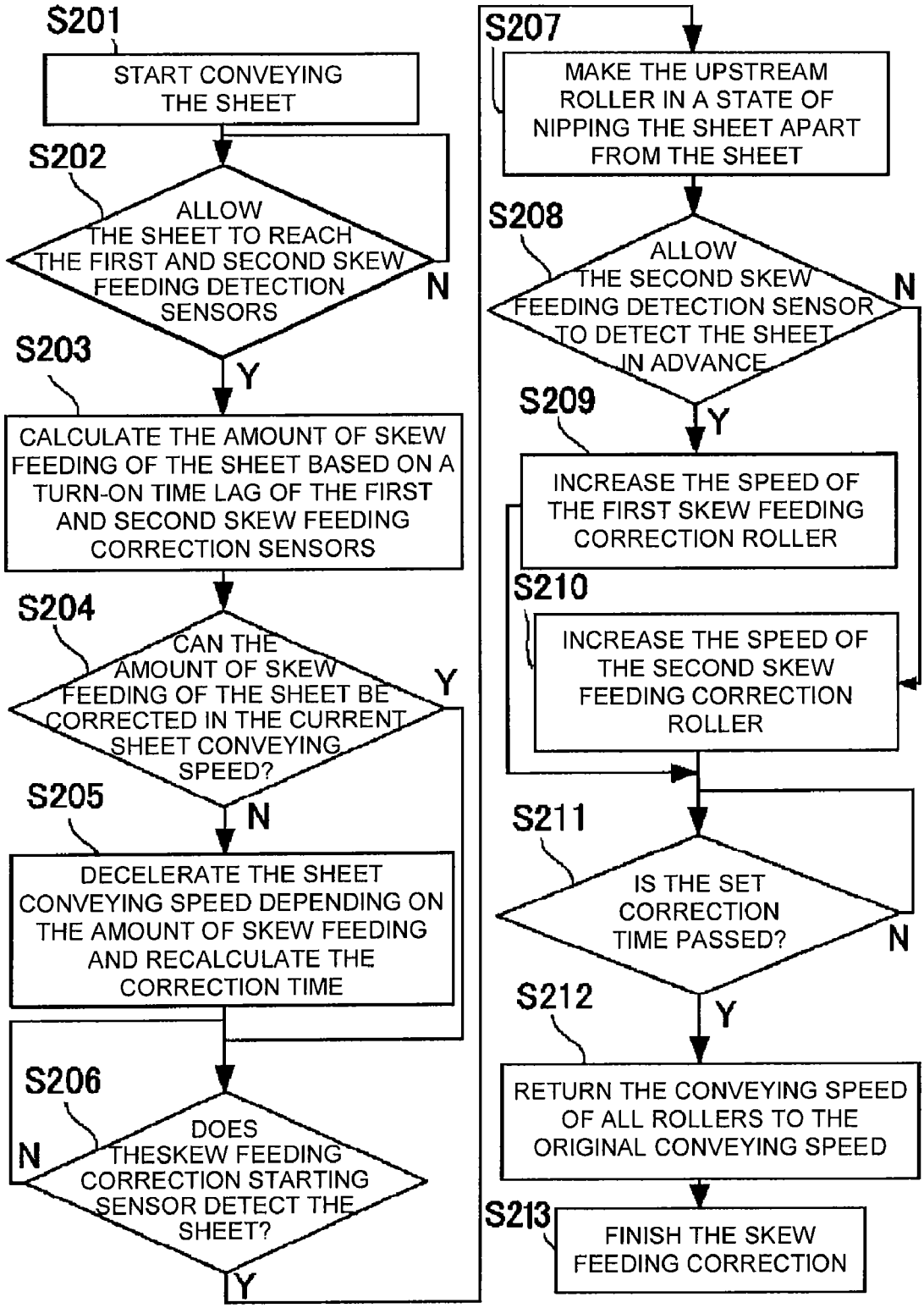
FIG. 7 is a flow chart describing another example of skew feeding correction control by the skew feeding correction unit.

Subsequently, the skew feeding correction control in which skew feeding correction is performed by decelerating the sheet conveying speed of the skew feeding correction roller will be described with reference to the flow chart illustrated in FIG. 7.

When sheet conveying is started (S201), the sheet is entered into the skew feeding correction portion 101. Thereafter, when the edge of the sheet reaches the first skew feeding detection sensor 208 and the second skew feeding detection sensor 209 (Y of S202), the first skew feeding detection sensor 208 and the second skew feeding detection sensor 209 are turned on.

Here, when the sheet is skew-fed, the timing when the first skew feeding detection sensor 208 and the second skew feeding detection sensor 209 are turned on is different. Thus, the CPU 501 calculates (detects) the amount of skew feeding based on a turn-on time lag of the first skew feeding detection sensor 208 and the second skew feeding detection sensor 209 as well as the sheet conveying speed (S203).

Subsequently, the CPU 501 compares the calculated amount of skew feeding with the amount of correctable skew feeding based on the sheet conveying speed which is stored in the ROM 502 and then determines whether the amount of skew feeding of the sheet can be corrected in the current sheet conveying speed (S204).

As the result of comparison, when the CPU 501 determines that the amount of skew feeding can be corrected (Y of S204), the CPU 501 waits for the skew feeding correction starting sensor 211 to detect the sheet (S206). Thereafter, when the skew feeding correction starting sensor 211 detects the sheet (Y of S206), the upstream roller 210 in a state of nipping the sheet is released (nip release) (S207) to make it apart from the sheet.

Then, it is confirmed whether the first skew feeding detection sensor 208 detects the sheet in advance. When the sheet is detected by the first skew feeding detection sensor 208 in advance (Y of S208), the speed of the first skew feeding correction roller 201 is decelerated (S209). In this regard, a value to decelerate the speed varies depending on the amount of skew feeding.

When the sheet is not detected by the first skew feeding detection sensor 208 in advance (N of S208), the speed of the second skew feeding correction roller 202 is decelerated (S210). In this regard, a value to decelerate the speed varies depending on the amount of skew feeding.

When the set correction time is passed after decelerating the speed of the first skew feeding correction roller 201 or the second skew feeding correction roller 202 (Y of S211), the conveying speed of all rollers whose speed is changed is returned to the original conveying speed before the sheet reaches the skew feeding correction portion 101 (S212). Thus, the skew feeding correction is finished (S213).

As the result of comparison, when it is determined that the correction cannot be performed (N of S204), in other words, when it exceeds the correctable skew feeding amount, the sheet conveying speed in which skew feeding can be corrected is determined according to the amount of skew feeding and the sheet conveying speed is reduced (decelerated). When the sheet conveying speed is decelerated in such a manner, the correction time for correcting the sheet is recalculated (S205). The correction time based on the sheet conveying speed is stored in the ROM 502. After recalculating the correction time in such a manner, the ROM 502 waits for the skew feeding correction starting sensor 211 to detect the sheet (S206).

Subsequently, specific examples of the skew feeding correction control will be described.

When the sheet conveying speed is V0, a maximum correctable skew feeding amount is Z0. When the sheet conveying speed is V3, the maximum correctable skew feeding amount is Z1. Here, the relationship of the sheet conveying speeds V0 and V3 is V0>V3. The maximum correctable skew feeding amount becomes smaller as the sheet conveying speed becomes faster. The relationship of the maximum correctable skew feeding amounts Z0 and Z1 is Z0<Z1.

Figure 8:
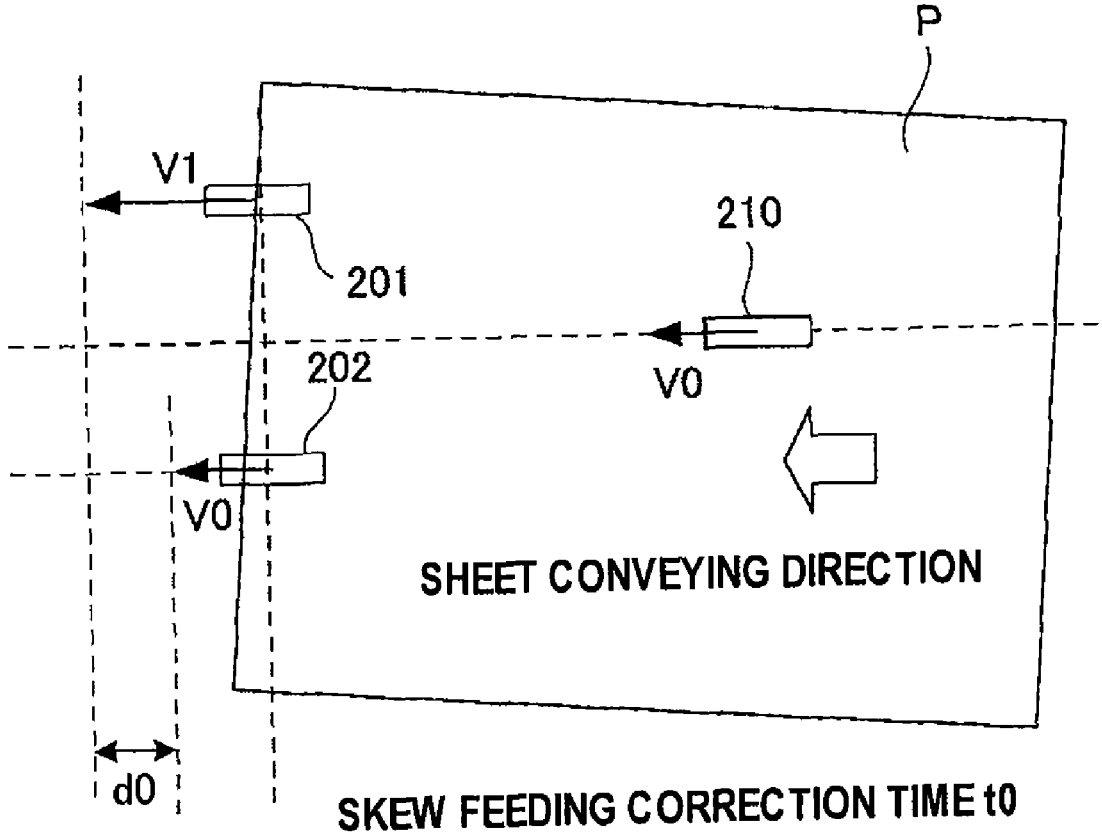
FIG. 8 is a first diagram describing a first specific example of skew feeding correction control operation by the skew feeding correction unit.
Figure 9:
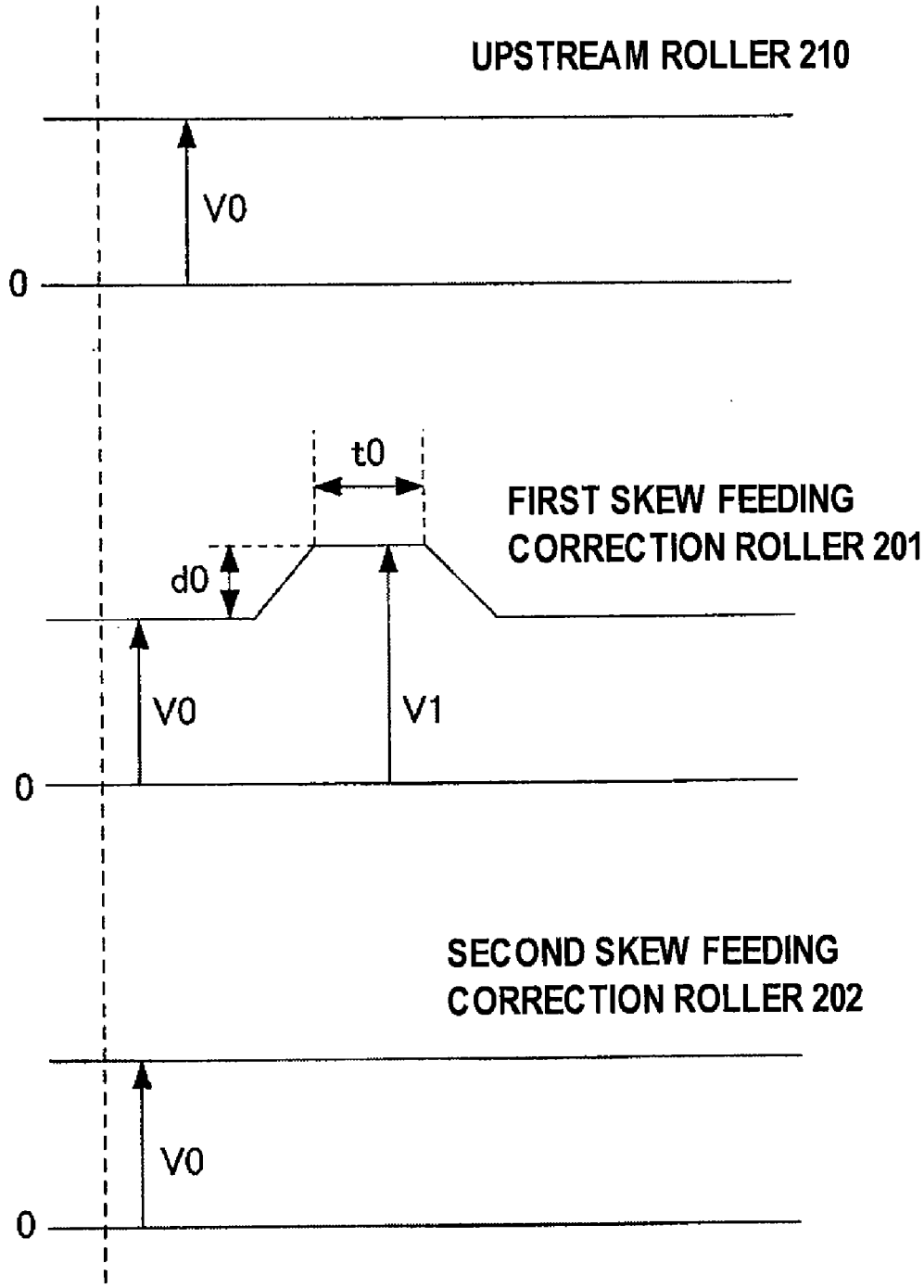
FIG. 9 is a second diagram describing the first specific example of skew feeding correction control operation by the skew feeding correction unit.

FIG. 8 is a diagram illustrating a state in which the amount of skew feeding of the sheet conveyed at the sheet conveying speed V0 is Z2 (0<Z2<Z0), namely the sheet P is skew-fed in the range that enables the sheet to be corrected. In this case, the edge portion at the front side of the sheet P is preceded. Therefore, as illustrated in FIG. 9, the speed of the first skew feeding correction roller 201 corresponding to the edge portion at the back side of the sheet P is accelerated to V1 and a speed difference between the first skew feeding correction roller 201 and the second skew feeding correction roller 202 is d0.

Figure 10:
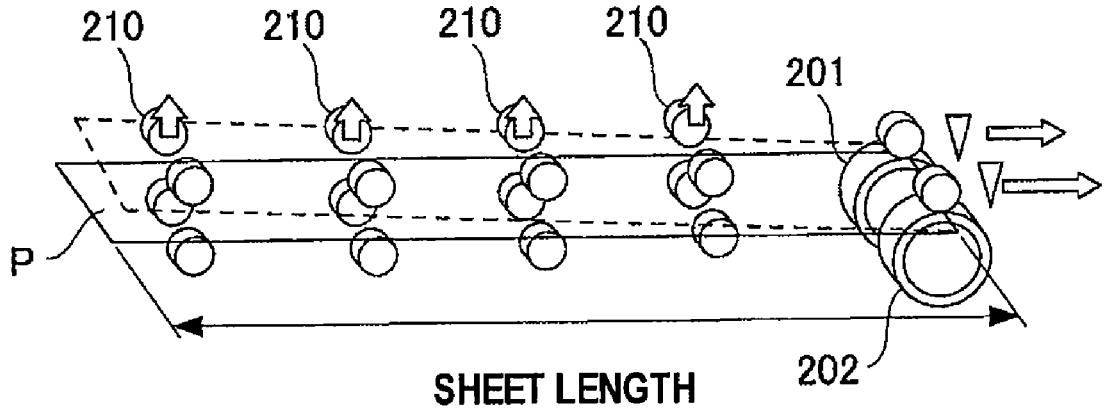
FIG. 10 is a third diagram describing the first specific example of skew feeding correction control operation by the skew feeding correction unit.

The skew feeding correction of the sheet P can be carried out by performing the speed control for the first skew feeding correction roller 201 within a previously set skew feeding correction time (period) t0. At this time, when the sheet P is nipped by the upstream roller 210 (it is not always one) located at the upstream of the first skew feeding correction roller 201 and the second skew feeding correction roller 202, the upstream roller 210 is moved apart from the sheet so as to be in a spaced state as illustrated in FIG. 10.

Figure 11:
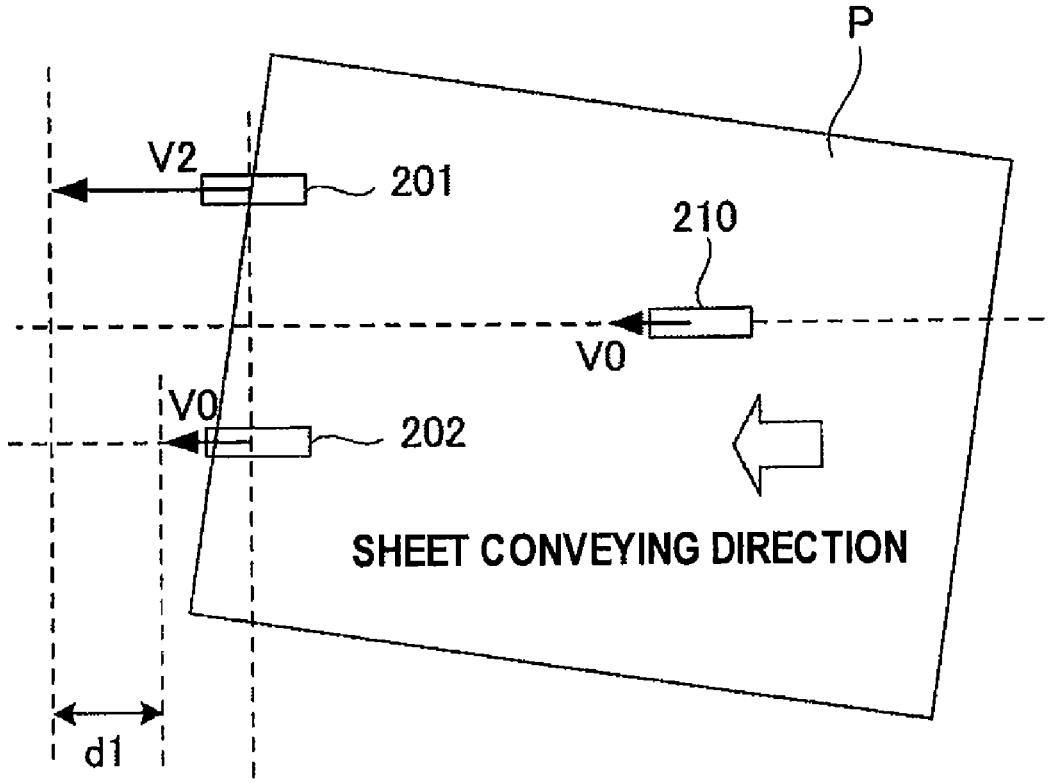
FIG. 11 is a first diagram describing a second specific example of skew feeding correction control operation by the skew feeding correction unit.
Figure 12:
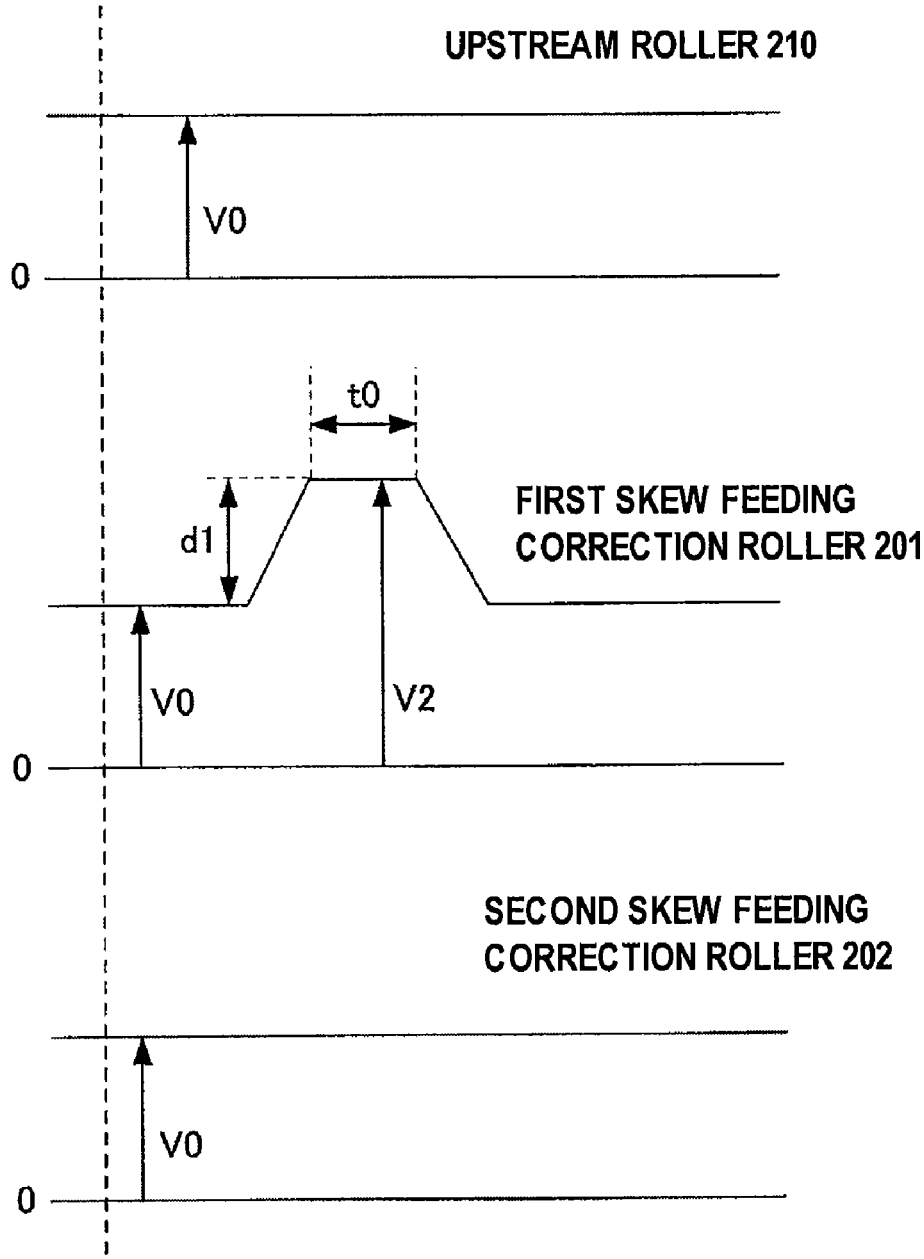
FIG. 12 is a second diagram describing the second specific example of skew feeding correction control operation by the skew feeding correction unit.

FIG. 11 is a diagram illustrating a state in which the amount of skew feeding of the sheet P is Z3 close to Z0, namely, although the amount of skew feeding of the sheet P is large, the sheet P is skew-fed in the range that enables the sheet to be corrected. In this case, the edge portion at the front side of the sheet P is preceded. Therefore, as illustrated in FIG. 12, the speed of the first skew feeding correction roller 201 corresponding to the edge portion at the back side of the sheet P is accelerated to V2(>V1) and a speed difference between the first skew feeding correction roller 201 and the second skew feeding correction roller 202 is d1.

Here, even when the amount of skew feeding of the sheet is close to Z0, the speed difference d1 is increased. Thus, a turning speed of the sheet becomes faster, which enables to skew feeding of the sheet to be corrected. The skew feeding correction of the sheet P can be carried out by performing the speed control for the first skew feeding correction roller 201 within a previously set skew feeding correction time (period) t0. In this regard, at this time, when the sheet P is nipped by the upstream roller 210 (it is not always one), the upstream roller 210 is in a spaced state as illustrated in FIG. 10.

Figure 13:
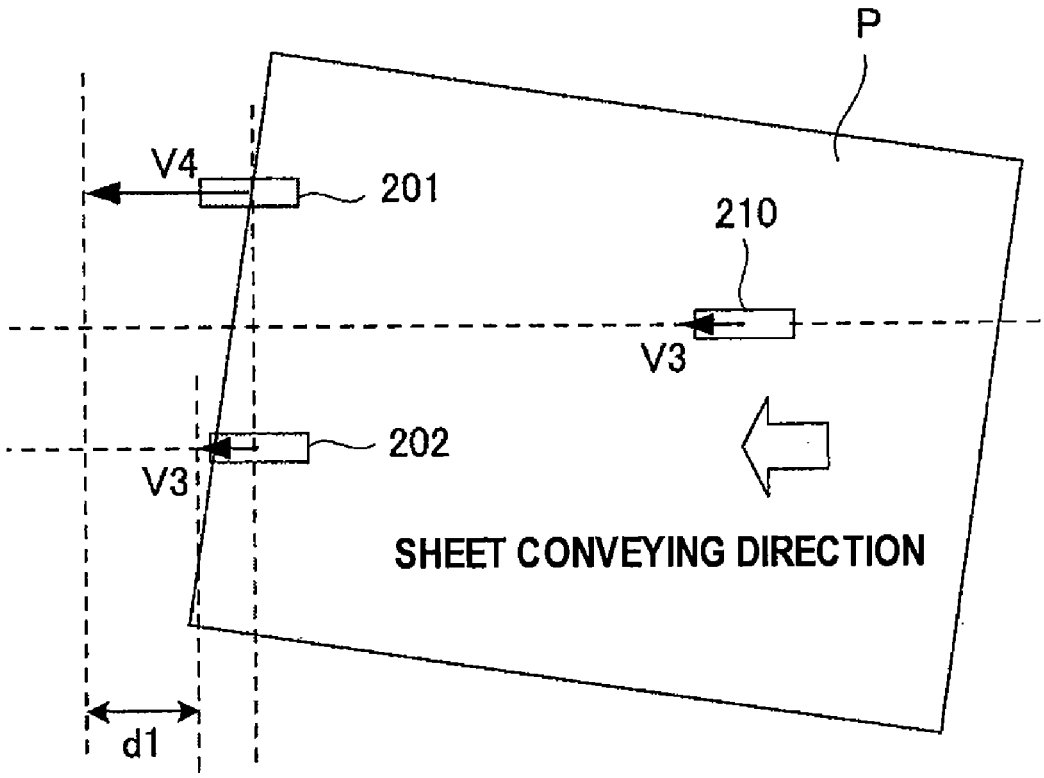
FIG. 13 is a first diagram describing a third specific example of skew feeding correction control operation by the skew feeding correction unit.

FIG. 13 is a diagram illustrating a state when the amount of skew feeding of the sheet P is Z4 (Z0<Z4<Z1) exceeding the maximum correctable skew feeding amount Z0 at the sheet conveying speed V0. In this case, when the sheet conveying speed is V0, skew feeding correction cannot be performed in the skew feeding correction portion 101.

Figure 14:
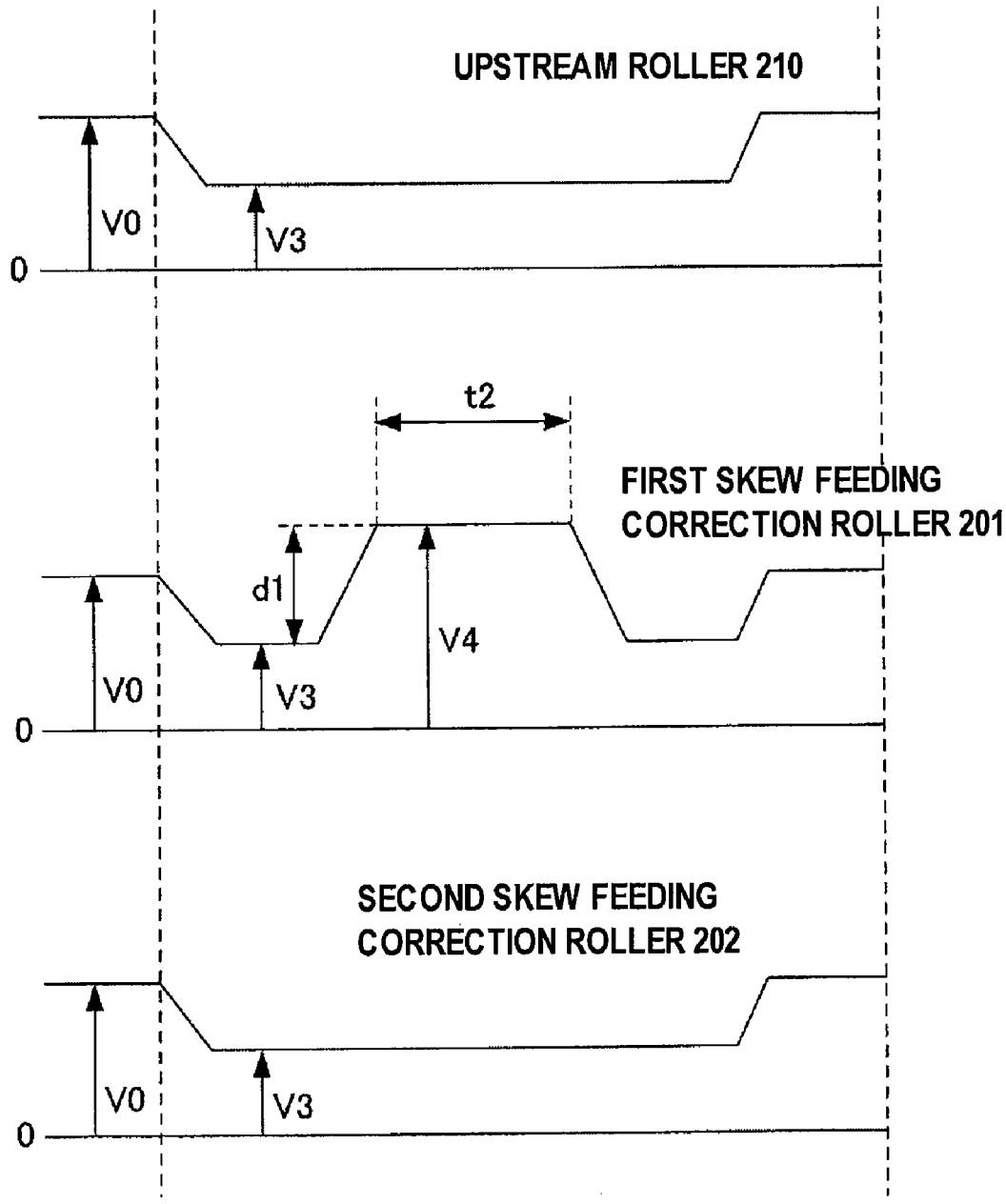
FIG. 14 is a second diagram describing the third specific example of skew feeding correction control operation by the skew feeding correction unit.
Figure 15:
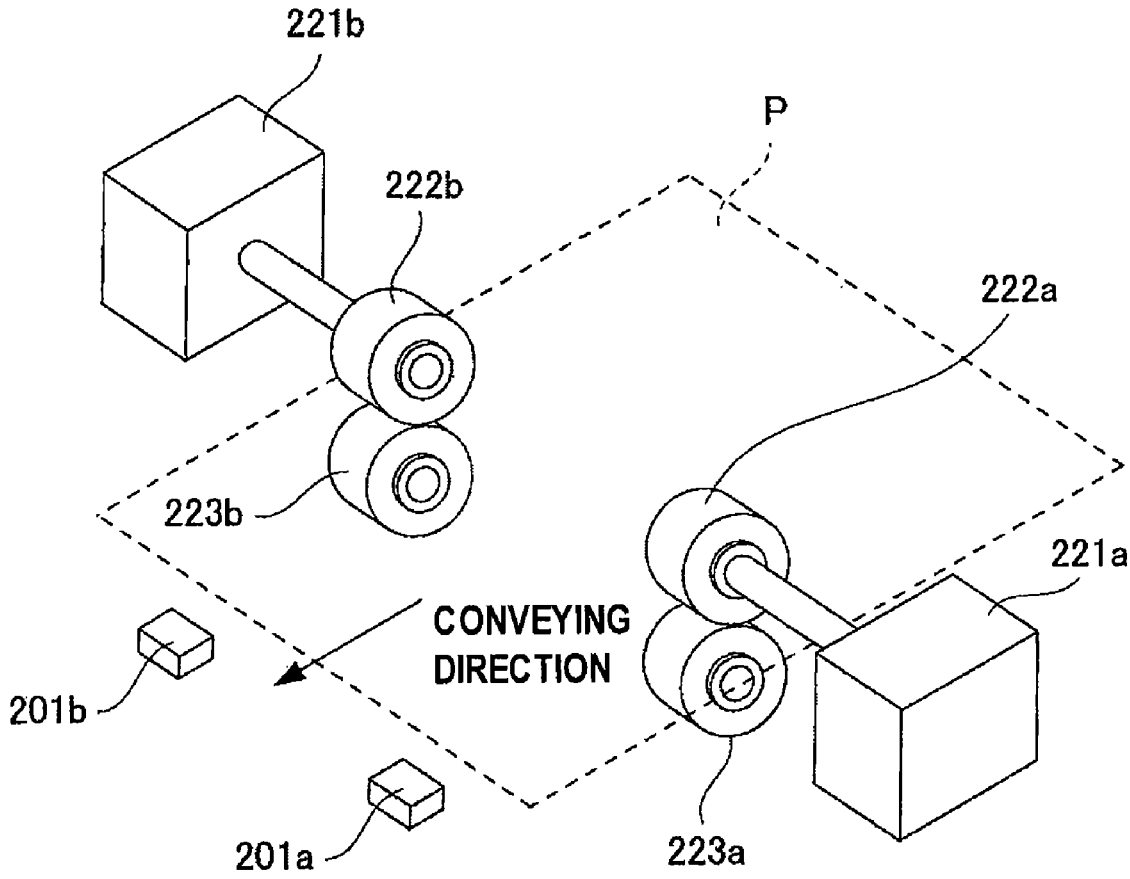
FIG. 15 PRIOR ART
FIG. 15 is a diagram describing a structure of a conventional skew feeding correction portion.

In such a case, namely, when it exceeds the correctable skew feeding amount, the sheet conveying speed in which skew feeding can be corrected is determined according to the amount of skew feeding. In this case, as illustrated in FIG. 14, the sheet conveying speed of the upstream roller 210 is decelerated to V3 and the sheet conveying speed of the first skew feeding correction roller 201 and the second skew feeding correction roller 202 is decelerated to V3. When the sheet conveying speed is decelerated in such a manner, the correction time for correcting the sheet is recalculated.

The sheet conveying speed of the upstream roller 210, the first skew feeding correction roller 201, and the second skew feeding correction roller 202 is decelerated to V3. Then, the sheet P is conveyed to the first skew feeding correction roller 201 and the second skew feeding correction roller 202 at the sheet conveying speed V3 by the upstream roller 210.

Thereafter, the edge portion at the front side of the sheet P is preceded. Therefore, the sheet conveying speed of the first skew feeding correction roller 201 corresponding to the edge portion at the back side of the sheet P is accelerated from V3 to V4 and a speed difference between the first skew feeding correction roller 201 and the second skew feeding correction roller 202 is d1. Further, skew feeding correction of the sheet P is performed by setting the skew feeding correction time to a recalculated correction time t2.

In such a case, when the amount of skew feeding of the sheet P exceeds the correctable skew feeding amount, the sheet conveying speed is decelerated and the correction time for correcting the sheet is recalculated based on the decelerated sheet conveying speed. The skew feeding correction of the sheet P can be carried out by conveying the sheet within the skew feeding correction time t2 at the speed difference d1 between the first skew feeding correction roller 201 and the second skew feeding correction roller 202. In this regard, at this time, when the sheet P is nipped by the upstream roller 210 (it is not always one), the upstream roller 210 is in a spaced state as illustrated in FIG. 10.

As described above, in the present embodiment, when the amount of skew feeding exceeds the predetermined amount of skew feeding, the first skew feeding correction roller 201, the second skew feeding correction roller 202, and the upstream roller 210 are decelerated before correcting skew feeding. Then, the sheet is conveyed to the first skew feeding correction roller 201 and the second skew feeding correction roller 202 which are decelerated by the decelerated upstream roller 210. This enables the speed difference when skew feeding of the first skew feeding correction roller 201 and the second skew feeding correction roller 202 is corrected to be minimized. As a result, skew feeding of the sheet can be corrected without giving damage to the sheet.

The case where the sheet conveying apparatus according to the present invention is applied to the color laser printer which is one example of the image forming apparatus has been described. However, the present invention is not limited thereto. For example, the sheet conveying apparatus according to the present invention can be applied to an image reader in order to perform an exact alignment of the sheet P at an image reading portion without inclination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-307499, filed Nov. 28, 2007, which is hereby incorporated by reference herein in its entirety.

What is claimed is:

1. A sheet conveying apparatus comprising:

a first skew feeding correction unit and a second skew feeding correction unit, which are arranged in a width direction that is perpendicular to a sheet conveying direction, that correct skew feeding of a sheet by turning the sheet while the sheet is conveyed;

a detection portion that outputs a signal depending on an amount of skew feeding of the sheet; and a control portion (i) that increases a speed difference between a sheet conveying speed of the first skew feeding correction unit and a sheet conveying speed of the second skew feeding correction unit depending on an amount of skew feeding of the sheet when the amount of skew feeding of the sheet is smaller than a predetermined amount, and (ii) that reduces the sheet conveying speed of the first skew feeding correction unit and the sheet conveying speed of the second skew feeding correction unit before the skew feeding correction process, in order to restrict a speed difference between the conveying speed of the first skew feeding correction unit and the conveying speed of the second skew feeding correction unit to under a predetermined value, when the amount of skew feeding of the sheet exceeds the predetermined amount.

2. The sheet conveying apparatus according to claim 1, further comprising a conveying roller, which is provided upstream of the first second skew feeding correction unit and the second skew feeding correction unit in the sheet conveying direction, that conveys the sheet to the first skew feeding correction unit and the second skew feeding correction unit;

wherein when the amount of skew feeding of the sheet exceeds the predetermined amount, the control portion decelerates the sheet conveying speed of the conveying roller before the skew feeding correction process.

3. The sheet conveying apparatus according to claim 2, wherein the conveying roller is moved apart from the sheet when skew feeding of the sheet is corrected by the first skew feeding correction unit and the second skew feeding correction unit.

4. The sheet conveying apparatus according to claim 1, wherein the detection portion has a plurality of edge detection sensors, which are provided in the width direction and upstream of the first skew feeding correction unit and the second skew feeding correction unit in the sheet conveying direction, that detect the edge of the sheet respectively.

5. The sheet conveying apparatus according to claim 1, further comprising a conveying roller, which is provided upstream of the first skew feeding correction unit and the second skew feeding correction unit in the sheet conveying direction, that conveys the sheet to the first skew feeding correction unit and the second skew feeding correction unit;

wherein when the amount of skew feeding exceeds the predetermined amount, the sheet conveying speed of the first skew feeding correction unit and the sheet conveying speed of the second skew feeding correction unit, in a state in which the first skew feeding correction unit and the second skew feeding correction unit performs the skew feeding correction process, is lower than the sheet conveying speed of the first skew feeding correction unit and the sheet conveying speed of the second skew feeding correction unit, in a state of in which the first skew feeding correction unit and the second skew feeding correction unit receives the sheet from the conveying roller.

* * * * *